US006845578B1

(12) United States Patent
Lucas

(10) Patent No.: US 6,845,578 B1
(45) Date of Patent: Jan. 25, 2005

(54) ILLUMINATED MULTI-IMAGE DISPLAY SYSTEM AND METHOD THEREFOR

(76) Inventor: Stephen J. Lucas, 2341 Selzer Rd., Evansville, IN (US) 47712

( * ) Notice: Subject to any disclaimer, the term of this patent is extended or adjusted under 35 U.S.C. 154(b) by 0 days.

(21) Appl. No.: 10/398,623

(22) PCT Filed: Aug. 3, 2001

(86) PCT No.: PCT/US01/24456

§ 371 (c)(1),
(2), (4) Date: Apr. 7, 2003

(87) PCT Pub. No.: WO03/015064

PCT Pub. Date: Feb. 20, 2003

(51) Int. Cl.[7] ..... A47F 11/06

(52) U.S. Cl. ..... 40/427; 40/453; 40/541; 65/61

(58) Field of Search ..... 40/427, 446, 453, 40/454, 541, 564, 549, 563, 714, 715; 65/44, 61, 102

(56) References Cited

U.S. PATENT DOCUMENTS

| | | | | | |
|---|---|---|---|---|---|
| 3,318,032 | A | * | 5/1967 | Robison et al. | 40/714 |
| 4,096,656 | A | * | 6/1978 | Diceglie | 40/564 |
| 4,768,300 | A | * | 9/1988 | Rutili | 40/546 |
| 5,265,357 | A | * | 11/1993 | Yu | 40/714 |
| 5,313,724 | A | * | 5/1994 | Warner | 40/714 |
| 5,433,024 | A | * | 7/1995 | Lerner | 40/546 |
| 6,119,382 | A | * | 9/2000 | Hakkert | 40/406 |
| 6,536,146 | B2 | * | 3/2003 | Ericson | 40/453 |
| 2003/0066221 | A1 | * | 4/2003 | Cheng | 40/564 |

* cited by examiner

*Primary Examiner*—Gary C. Hoge
(74) *Attorney, Agent, or Firm*—Gary K. Price, Esq.

(57) ABSTRACT

A display system for presenting multiple images from a single art object depending upon the observer's viewing angle comprising a housing, a protective cover, a distortion lens, an art object, a support means for securing a lighting system contained within the housing, and a cooling system and power source within the housing.

14 Claims, 7 Drawing Sheets

Arrows indicate relative direction of illumination

ILLUMINATED MULTI-IMAGE DISPLAY SYSTEM AND METHOD THEREFOR

CROSS REFERENCES TO RELATED APPLICATIONS

None

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates to pictorial displays and methods therefor and more particularly, optical and mechanical arrangements using a distortion lens whereby such pictorial display appears distorted as viewers view the display, and further, creates unlimited images from such pictorial display with the slightest shift in viewing direction.

2. Background Information

A display of an illuminated image is often desirable in a variety of aesthetic and commercial environments. Such display is often desirable because illumination, if carefully designed, can compliment the contents of an image, as well as make features of the image discernable when there is little ambient light. Additionally, the illumination attracts the attention of those in its vicinity.

A review of prior image displays teach that illuminated picture frames are well known. Prior art which teaches the use of lights to illuminate pictures are disclosed in the patents to Reefe U.S. Pat. No. 2,549,928, Diceglie U.S. Pat. No. 4,096,656 and Torrence U.S. Pat. No. 4,922,384. However, the art of using a distorted lens in order to distort the illuminated image as discussed herein, is not addressed by any of these patents. Nor does the prior art teach of a display which creates unlimited images from a single illuminated pictorial display with the slightest shift in the angle of viewing. In view of the known art, there continues to be a demonstrable need for more effective ways to display the variety of images currently available for aesthetic and commercial purposes. Accordingly, there is a need for a system to accentuate the view of images currently available.

SUMMARY OF THE INVENTION

The present invention is a display system for displaying an illuminated art object, comprising a housing, a protective cover, a distortion lens, and an art object or painting. The system further comprising a support means for securing a lighting system contained within the housing, and a cooling system and power source within the housing.

The display system of the present invention allows a user to view a single art object through the distortion lens, and uniquely creates for the viewer unlimited floating images from that single art object depending upon the viewer's viewing angle.

The present invention provides an apparatus for displaying an illuminated image of a size suitable for a wall hanging or of a size suitable for placement on a desk, however, larger size illuminated images may be accommodated as well.

DESCRIPTION OF THE PREFERRED EMBODIMENTS

Figure 1:
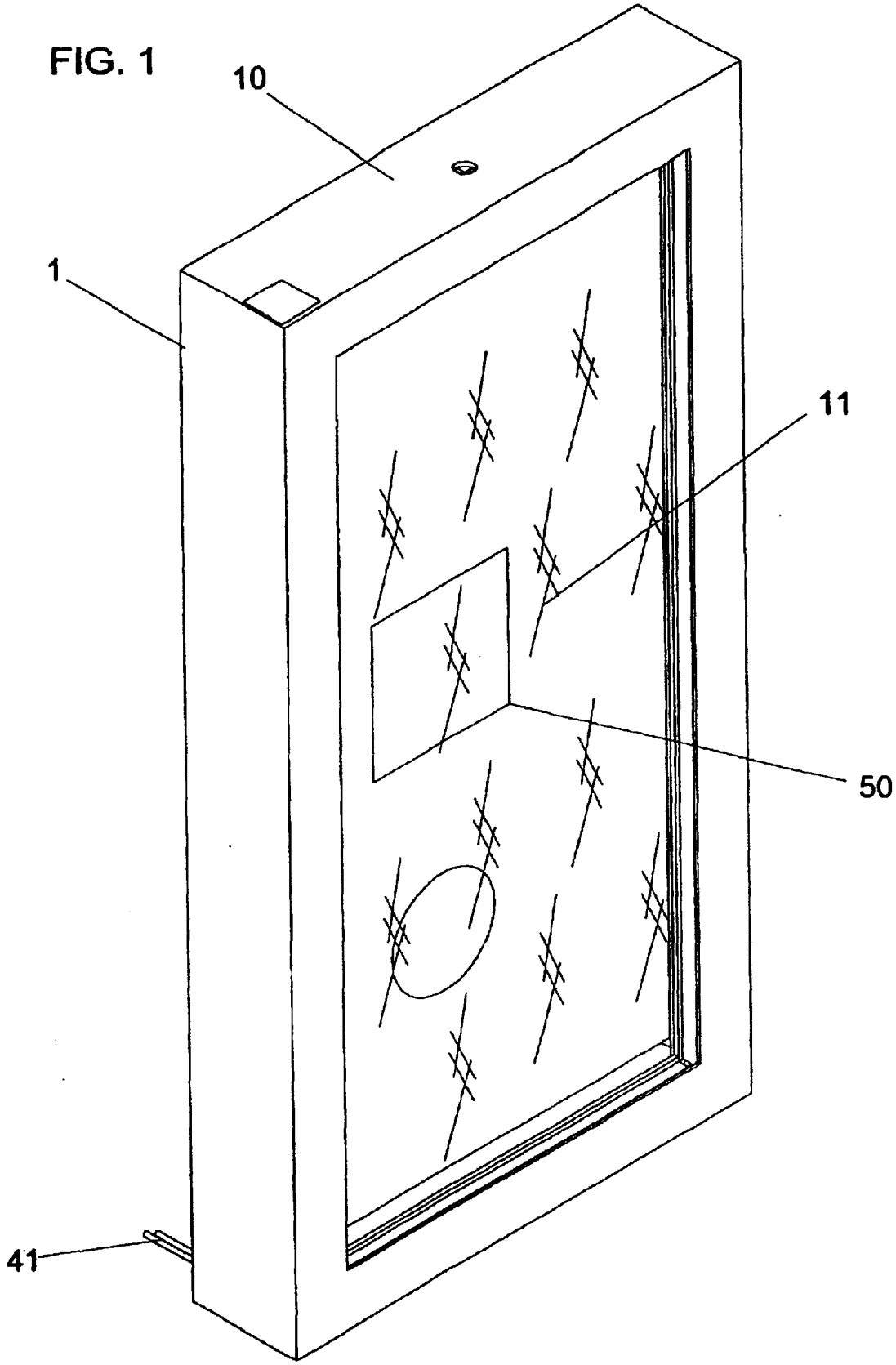
FIG. 1 is a perspective view of the present invention, an apparatus for displaying an illuminated image in a distorted form.
Figure 2:
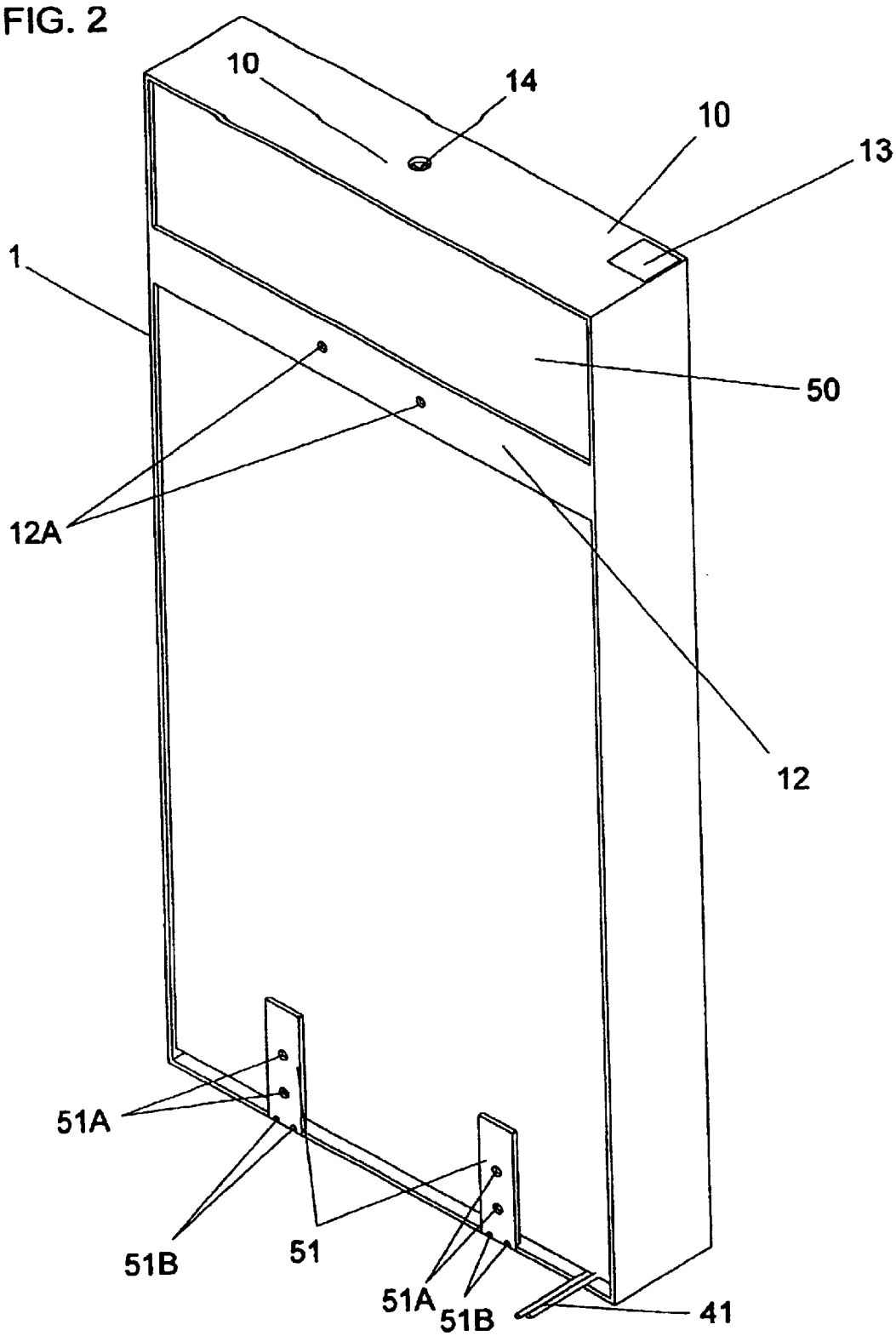
FIG. 2 is a rear view of the present invention.
Figure 3:
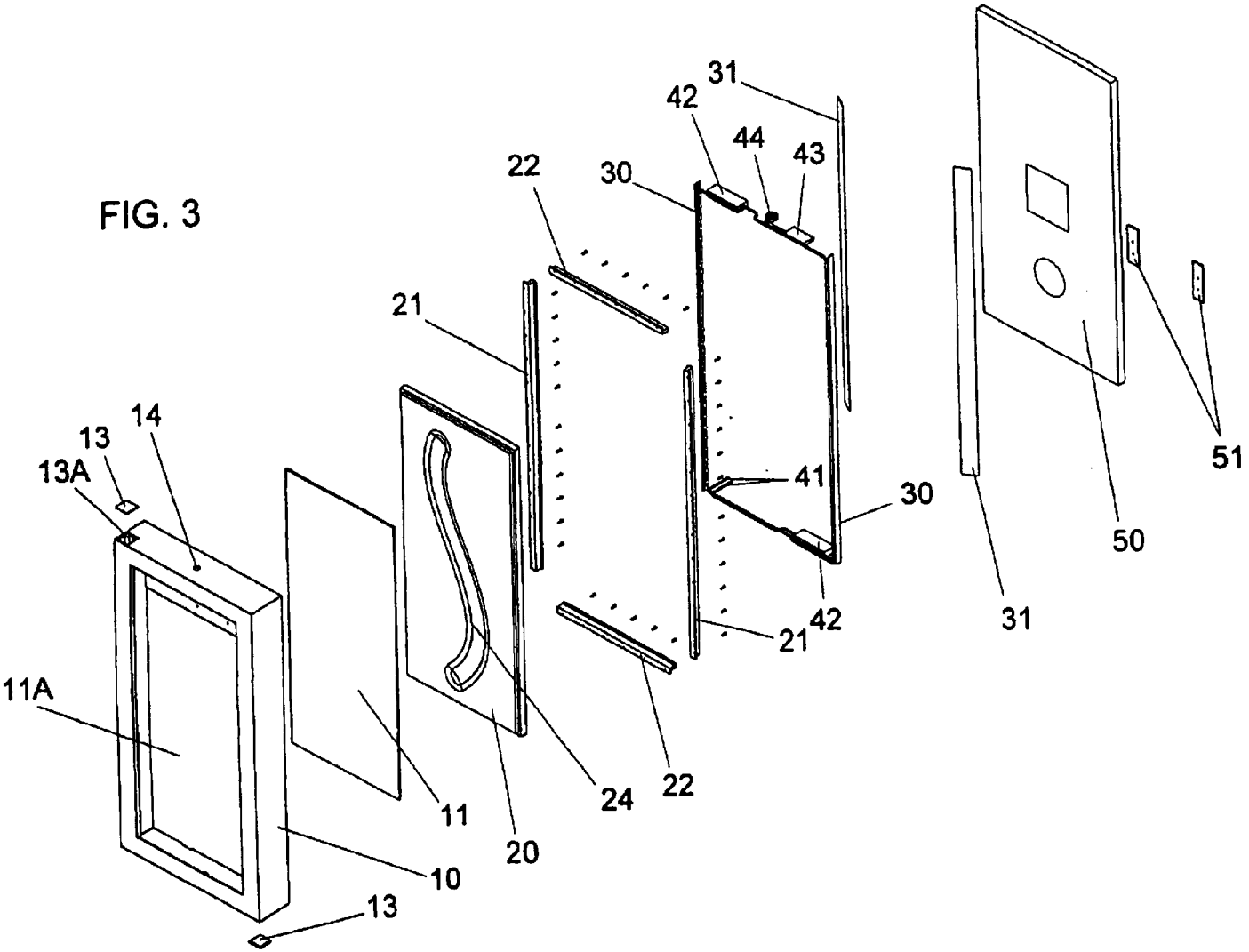
FIG. 3 is a perspective view of the display apparatus constructed in accordance with the present invention.

Referring now to FIGS. 1 and 3, there is shown an embodiment of the inventive display system designated generally as 1. Display system 1, which is preferably rectangular, comprises a housing 10, the housing 10 having a portal opening 11A and front borders 11B to support an art object or painting 50 as seen through a protective cover 11 and a distortion lens 20. The housing 10, protective cover 11, and distortion lens 20 are constructed similar in size to the art object 50 as shown in FIG. 2. The housing 10 having at least one access cover 13 and access clearance 13A, said access cover 13 and clearance 13A allows a user access to the inside of display system 1, and particularly, inside the housing 10 after assembly. Inside housing 10 further resides a support means for securing the lighting system contained within the system 1, and further support means for securing the said protective cover 11, distortion lens 20, and art object 50, as will be more fully explained hereinafter.

Referring now to FIG. 2, there is shown a rear view of the display system 1. The housing 10 including a mounting support 12 and at least one lower mounting strap 51, said mounting support 12 having at least one clearance 12A, and lower mounting strap 51 having at least one lower clearance 51A. As shown in FIG. 2, the lower mounting strap 51 further comprising at least one clearance for case mounting screws 51B for mounting said lower mounting strap 51 to the housing 10. In the preferred embodiment, the art object 50 is first mounted to a support backing (not shown), such as a sheet of plywood or particle board. Said support backing, then being the back side of the art object 50 is fastened to the mounting support 12 and the lower mounting strap 51 of the housing 10 using mount bolts or screws through clearances 12A and 51A.

Protective cover 11 is preferably molded of a transparent durable plastic. Distortion lens 20 is preferably molded of a transparent, colorless, durable plastic such as acrylic plastic, and, pursuant to the teachings herein, has sculptured therein, as will be explained, a plurality of individual cavities 24 that create a unique effect when viewing the art object 50 through the lens 20. The term "transparent", as used herein simply means being capable of transmitting light so that the image can be seen as if there was no intervening material. The transparent material can be made of that material identified above, or like material so long as it can transmit light therethrough.

While FIG. 3 shows a single sculptured cavity 24 in distortion lens 20, it will be appreciated that in practice, a plurality of cavities 24 of various shapes and sizes may be sculptured in distortion lens 20. Surrounding the perimeter of the inside of housing 10 a vertical locking mount 21 and a horizontal locking mount 22, which locking mounts 21 and 22 are used to secure the protective cover 11 and distortion lens 20 within the housing 10. The housing further having a light strip assembly 30.

Figure 5:
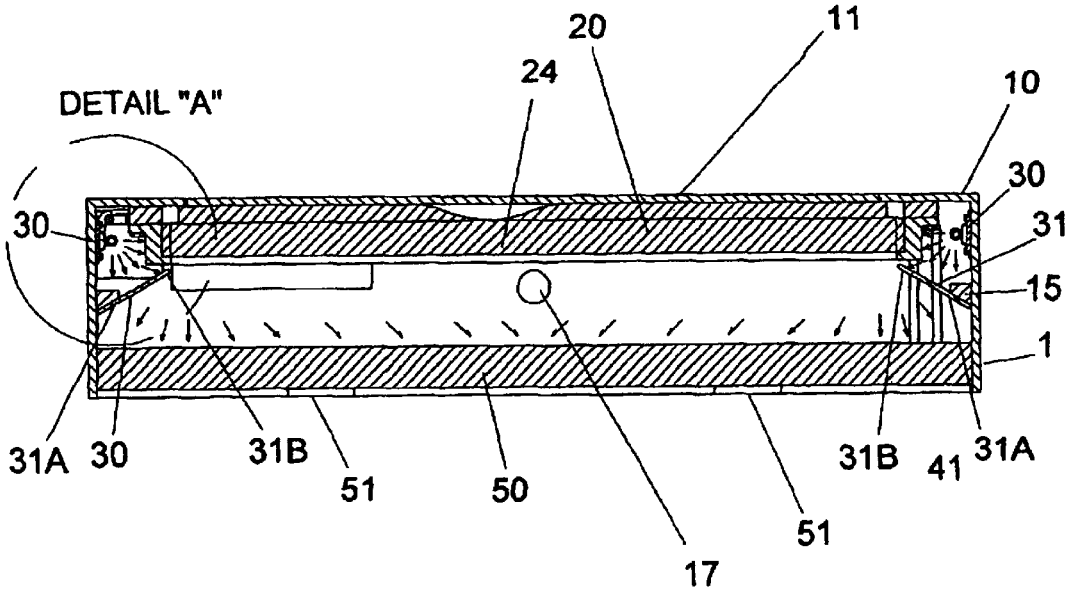
FIG. 5 is a cross sectional view of FIG. 4 which is the top section of the present invention, and includes an exploded view marked Detail "A" of a cross section of FIG. 5.
Figure 5:
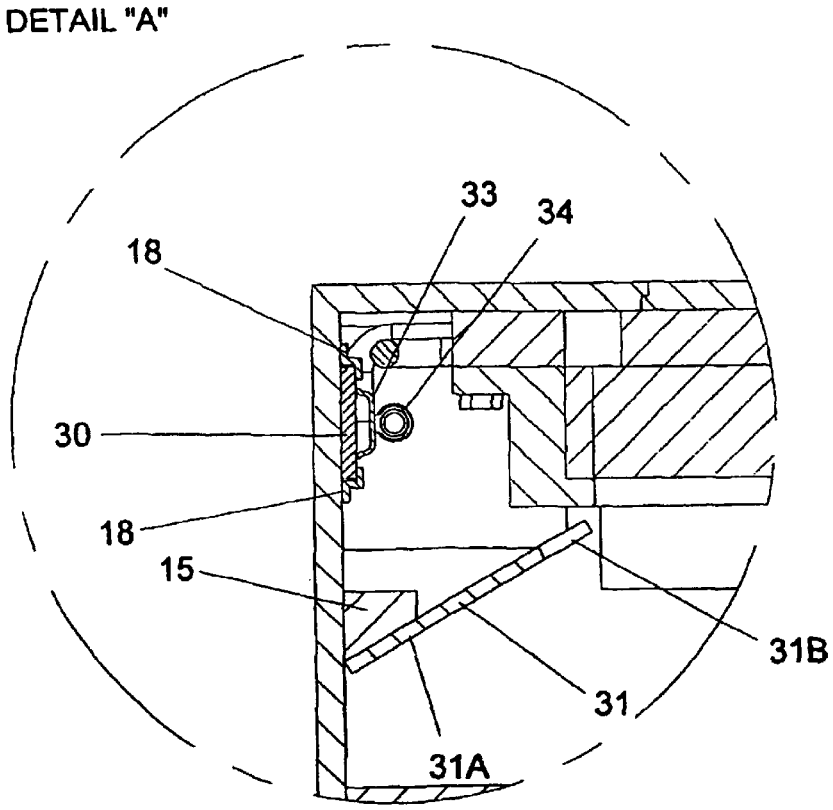
Figure 6:
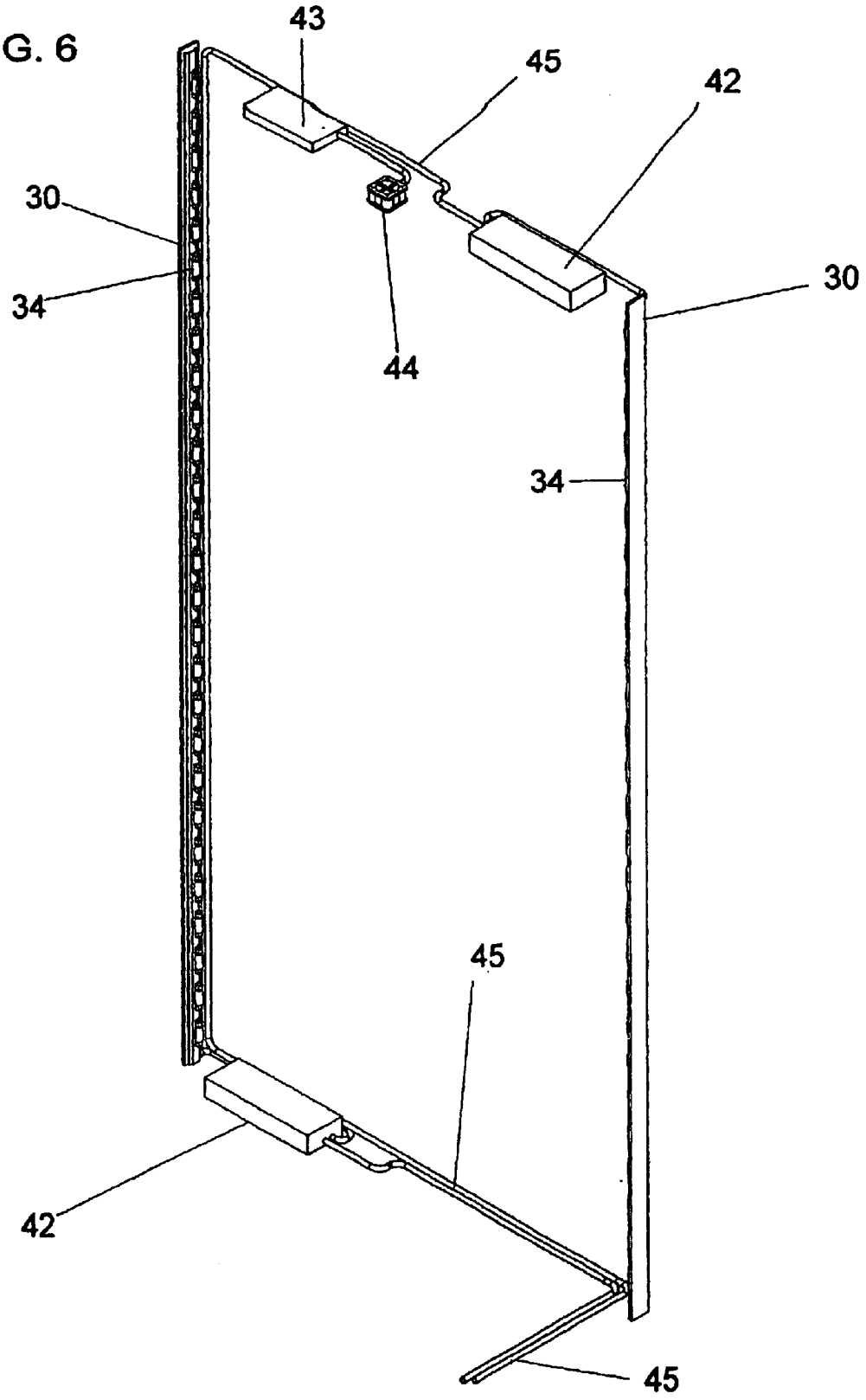
FIG. 6 is a perspective view of the light strip and connector assembly.

As shown in FIGS. 5 and 6, the light strip assembly 30 further comprising at least one lighting strip 33, at least one light strip mounting guides 18, a plurality of lights 34 connected within the lighting strip 33, and a power supply means, specifically a connection to power 41, a lighting ballast 42, and electrical wiring 45. The said connection to power 41, as shown in FIGS. 1 and 2, extends from the rear of housing 10 to an independent power supply (not shown). When illuminated the light strip assembly 30 emits light within the housing 10 and illuminates the art object 50. In order to avoid excess heat within the housing 10 caused by the said lighting system, the housing 10 further comprising an interior cooling means common to the art, specifically, at least one intake clearance 14, a cooling fan 44, a cooling fan controller 43, and a vent opening 17. The mounting of said cooling means is known in the art. The number of lighting strips 33 and lights 34 contained within the housing 10 being dependent upon the dimensions of the housing 10; it being the objective of the light system to include sufficient lighting 34 within the housing 10 to illuminate the art object 50 on display. In order to avoid a specular highlight effect, that being an over concentration of light in one location of the art object 50, or a shadowing effect of the art object 50, a diffusion panel 31, having a masked section 31A and a transparent portion 31B is installed at an angle over the entire length of the lighting strip 33. The diffusion panel 31 is affixed to at least one mount protrusion 15 and mounted at an angle as shown in FIG. 5 in order to evenly distribute the lighting within the housing 10, thereby evenly illuminating the art object 50. Said at least one mount protrusion 15 attached to the sides of the housing 10, and adjacent to the light strip assembly 30.

To assemble, first lie the housing 10 face down on a flat surface with the portal opening 11A and the front border 11B resting on the flat surface, and the mounting support 12 and lower mounting strap 51 outwardly exposed. Light strip assembly 30 are vertically positioned to the sides of housing 10 and slidably interposed between the light strip mount guides 18 which are fastened by screws to the sides of housing 10 as shown in FIG. 5. Said lighting strip 33 and lights 34 are then mounted to assembly 30. Wiring of the lighting system is well known to those skilled in the illumination art. The interior cooling system and power source as discussed above are installed in the housing 10 (shown in FIG. 3). Wiring of the cooling system and power source is well known to those skilled in those respective arts.

Figure 4:
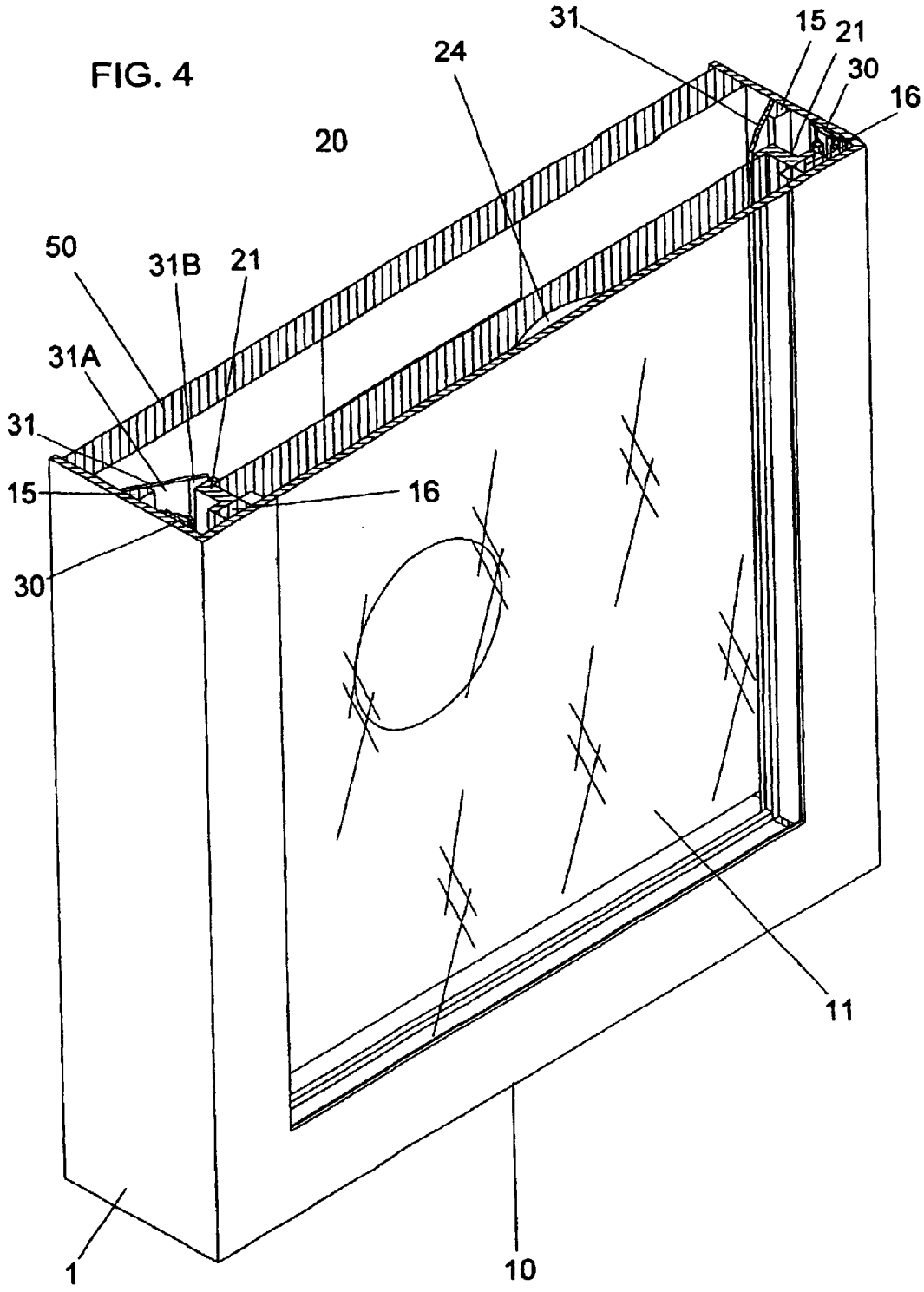
FIG. 4 is a perspective view of the top section of the present invention.

Protective cover 11 is placed in the housing 10, such protective cover 11 being exposed in the portal opening 11A of housing 10, and resting on the front borders 11B of housing 10. Next, a plurality of spacers 16 (shown in FIG. 4) are selectively placed at the corners of protective cover 11. The distortion lens 20 is then placed in the housing 10 and resting on the spacers 16, with the flat side of the distortion lens 20, as shown in FIG. 4, and as will be further described herein, outwardly exposed and facing the rear of the housing 10. Once in place, the protective cover 11 is held in spaced apart relationship with the distortion lens 20, such space being the approximate width of the spacers 16, in order to further promote air circulation within the housing 10. The distortion lens 20 is secured within the housing 10 by fastening the vertical locking mount 21 and the horizontal locking mount 22 to the sides of the housing 10, securely atop the distortion lens 20. Next, fasten the at least one mount protrusion 15 to the sides of the housing 10 and install the diffusion panel 31 so that the panel 31 is angled as shown in FIG. 5, in order to evenly emit light as previously discussed. To do so, the diffusion panel 31 includes said masked section 31A, which masked section 31A controls light from further passing within the housing 10 and to the art object 50, and the transparent portion 31B of diffusion panel 31 which allows passing of light within the housing 10. As previously discussed, the diffusion panel 31 should be adjusted, and angled so that light is properly emitted, thereby evenly illuminating the art object 50. Lastly, the art object 50 is installed within the housing 10 and mounted flush to the mounting support 12 and lower mounting strap 51 as previously discussed. The art object 50 is held in spaced apart relationship with the distortion lens 20 in order to further promote proper air circulation within the housing 10, and to create the unique viewing effects disclosed in the present invention.

The distortion lens 20 represents the critical feature of the present invention. The distortion lens 20 is a transparent, colorless, durable plastic such as acrylic plastic, and while the thickness may vary, preferably approximately 1¼" thick. The lens 20, prior to sculpturing said plurality of cavities 24, has a flat relatively smooth front and back side (not shown).

The sculpturing process requires, in general, carving out shapes on the lens 20. Such carvings, when completed, represent the said plurality of cavities 24, and are shaped in relative uniformity with the variety of shapes displayed on the art object 50.

To sculpture the said plurality of cavities 24 on the lens 20, the operator first cuts out various shapes using any cutting machine suitable for cutting plastic available on the market, such as, but not limited to a routing machine or a die grinder. Certain cavities 24 may be greater in depth than others, and preferably not penetrate completely through the lens 20. Once the carved shapes and depths are completed, the operator dry sands the lens 20 progressing from a grit 60 to a 600 grit sand paper in order to progressively achieve a smooth surface. Between changes of grades of sand paper, the operator applies a dry sponge sanding suited for sanding the various curves of the lens 20 in order to best maintain the original shapes as sketched on the lens 20. Once completed, one side of the lens remains flat and relatively smooth, while the opposite side, which side was sculptured by the operator as discussed herein, has a topically varied surface now containing a plurality of cavities 24, which cavities 24 are shaped in relative uniformity with the shapes displayed on the art object 50, and represents what has been referred to as the distortion lens 20.

To remove any minor scratches on the surfaces of the lens 20, the operator wet sands the lens 20 progressing from a grit 120 to 12,000 grit paper. Lastly, the operator applies a common finish polish and cleaner.

In operation, the lights 34 are illuminated to pass light within the housing 10. The light reflects off the diffusion panel 31, the masked section 31A blocking the light, and the transparent portion 31B of the panel 31 allowing light to pass, thereby controllably emitting light evenly within the housing 10 and illuminating the art object 50. The light passes through the transparent portion 31B of the diffusion panel 31 in the relative direction of illumination as indicated by the arrows in FIG. 5.

Figure 7:
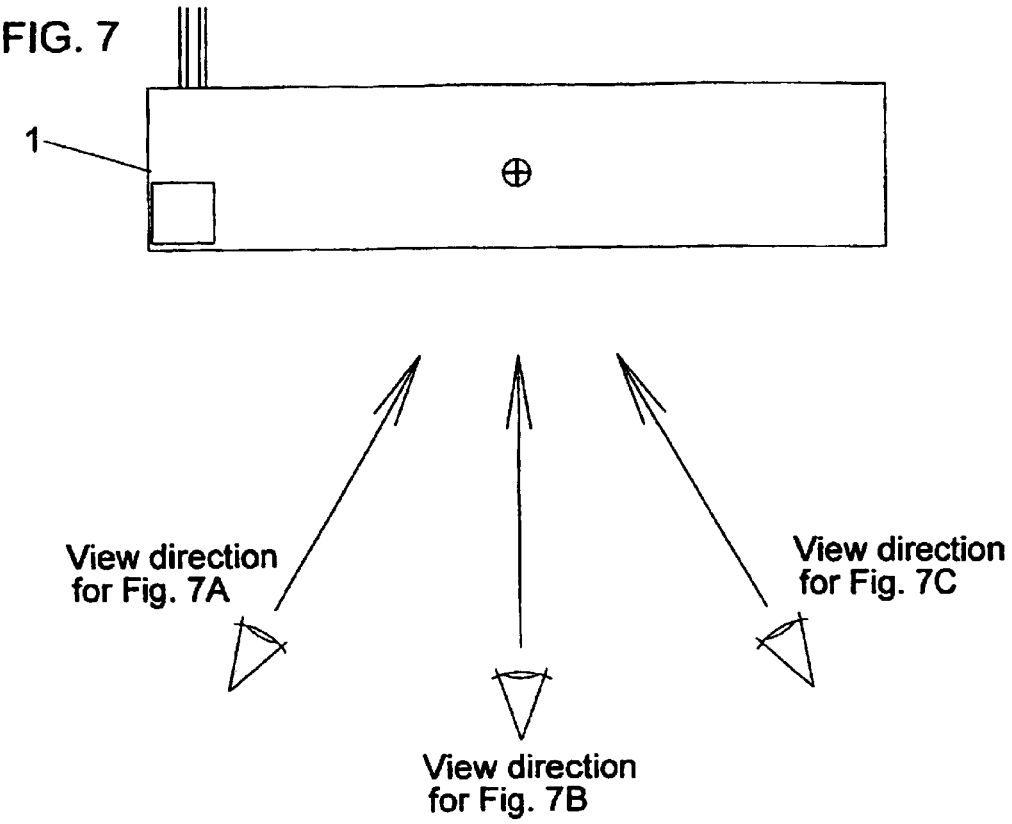
FIG. 7 is a diagrammatic view illustrating differences in the angle of perspective from which an observer "sees" what appears to be a different image when viewing the identical segment of an image from three directions.
Figure 7A:
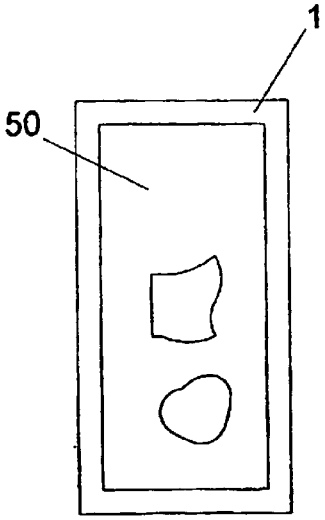
Figure 7B:
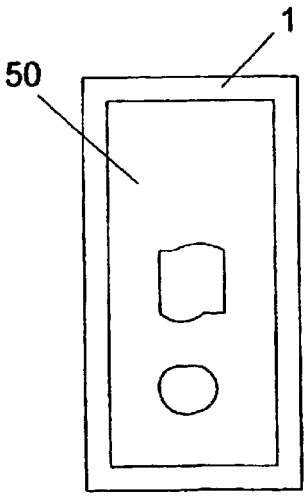
Figure 7C:
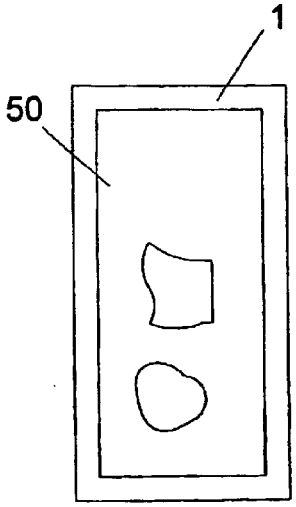

When viewing the art object 50, the shapes displayed on the art object 50 are visible through the protective lens 11 and the distortion lens 20, and will appear distorted, and have the effect of floating forms where the slightest shift in viewing direction alters the entire view. Such effect is not only a unique, attractive and appealing appearance to the viewer, but creates for the viewer unlimited images from a single art object 50 depending upon the viewer's viewing angle. For example, and referring now to FIG. 7, to an observer viewing a segment of art object 50 at the angle designated as View Direction for FIG. 7A, such image segment will appear as shown in FIG. 7A. A slightest shift in view angle alters the appearance of the segment's distorted shape. As such, again referring to FIG. 7, when viewing the segment of art object 50 at the angle designated as View Direction for FIG. 7B, such distorted image segment will appear altered, as shown in FIG. 7B, when compared with such segment's appearance when viewing from View Direction for FIG. 7A; and, likewise, when viewing the segment at the angle designated as View Direction for FIG. 7C, such distorted image will appear altered, as shown in FIG. 7C, when compared with such segment's appearances when viewing from View Directions for FIG. 7A or 7B.

For purposes of example only, the art object 50, as shown in FIGS. 1 and 3, displays the shape of a rectangle and circle. However, it should be understood that other shapes for the display may also be used. For example, other geometric shapes would be suitable, as well as other types of artwork having more natural imagery can be accommodated. Further, while in the preferred embodiment the carved cavities 24 do not penetrate completely through the lens 20, it should be understood that selected cavities 24 may be carved completely therethrough thereby avoiding the visual distortion effect of the display 1 at the selected cavity 24 location.

In addition, it should be clear that the display of the present invention may be scaled up or down in size. Moreover, various shapes of frames and works of art can be used with many different style displays.

Thus there has been disclosed a unique embodiment of a lighting system that provides varying optical effects. Allowing a user to view a single art object in spaced apart relationship with a reflective distortion lens in a variety of aesthetic and commercial environments, that uniquely creates for the viewer unlimited images from that single art object depending upon the viewer's viewing angle.

It should be understood by one skilled in the art, after reviewing this disclosure, can conceive of various embodiments not disclosed herein that are apart of the present invention and that are covered by the claims herein. Thus the scope of the invention should be determined by the appended claims and their legal equivalents, rather than by the examples given.

I claim:

1. A display system for presenting multiple images from an art object depending upon the observer's viewing angle, said display system comprising:

an art object, a housing, said housing having an inner housing, and a portal opening for viewing the art object, a protective cover, a lens, such lens having a flat surface on a front face of said display system and a sculptured surface, said sculptured surface having therein a plurality of carved individual cavities, a plurality of locking mounts, such locking mounts used to secure the protective cover and lens within the inner housing, and a diffusion panel diffusing light from said light source away from said portal and toward said art object, a means for cooling the housing in order to avoid excess heating within the housing, and a power supply means.

2. The display system of claim 1, wherein said protective cover is fabricated of transparent plastic, and said lens is fabricated of transparent, colorless plastic.

3. The display system of claim 1, wherein the housing additionally comprising at least one access cover and access clearance to allow access to the inner housing.

4. The display system of claim 1, wherein the housing further comprising a means for mounting the art object to the housing.

5. The display system of claim 1, wherein the lens is held in spaced apart relationship with the art object.

6. The display system of claim 1, wherein the light source comprising at least one lighting strip, at least one light strip mounting guide, and a plurality of lights connected within the lighting strip, a diffusion panel including a masked section, said masked section preventing a concentration of light on a portion of said art object closest to said light source.

7. The display system of claim 1, wherein the diffusion panel further comprising a masked section and a transparent portion, such diffusion panel being installed in the inner housing at an angle over the lighting strip, in order to evenly distribute the lighting within the housing, thereby evenly illuminating the art object.

8. The display system of claim 1, wherein the observer views the art object through the portal opening, the protective cover and the lens.

9. The display system of claim 1, wherein the plurality of cavities in the lens are of various shapes and sizes.

10. A multi-dimensional art display, the combination of a sheet of transparent, colorless, durable plastic, one side of which is flat and another side of which is flat with carved shapes, a protective cover in spaced apart relationship with an art object, and a source of diffuse light adjacent an edge of said first mentioned sheet and said source of diffuse light directing light toward said art object for evenly illuminating said art object.

11. A method for displaying multiple images from an art object depending upon the observers viewing angle comprising the steps of:

(a) providing an art object, (b) providing a housing, said housing having an inner housing, and a portal opening for viewing the art object, (c) mounting a flat protective cover over a lens in said housing, said lens having flat surfaces and said lens having a plurality of carved individual cavities in at least one of said flat surfaces, (d) securing the protective cover and said lens within the inner housing, (e) providing a diffusion panel adjacent said portal, and (f) passing light from a light source within the housing through said diffusion panel in order to even illuminate the said art object, and (g) cooling the housing in order to avoid excess heating within the housing.

12. The method of claim 11, wherein step (c) further includes:

carving out various shapes on the lens using a cutting machine, sanding the lens to achieve a smooth surface, dry sponge sanding the various curves of the lens in order to maintain the selected shapes on the lens, wet sanding the lens to remove any minor scratches on the surface of the lens, and polishing and cleaning the lens.

13. A method for displaying multiple images from a single image depending upon the observer's viewing angle, comprising carving various shapes in a flat, smooth surface of a transparent, colorless, durable plastic for viewing the single image therethrough, and thereupon forming the display system having varying optical effects, providing an art object in a housing, said housing having an inner housing, and a portal opening for viewing the art object, mounting a flat protective cover over a lens in said housing, said lens having flat surfaces and having a plurality of carved individual cavities in at least one of said flat surfaces, securing the protective cover and said lens within the inner housing, providing a diffusion panel adjacent said protective cover, and passing a light from a light source within the housing through sold diffusion panel in order to evenly illuminate the art object.

14. The method of claim 13 including the step of viewing the art object through the protective cover and lens.

* * * * *